US011841722B2

(12) United States Patent
Jian

(10) Patent No.: US 11,841,722 B2
(45) Date of Patent: Dec. 12, 2023

(54) CONTROLLING CIRCUIT FOR LOW-POWER LOW DROPOUT REGULATOR AND CONTROLLING METHOD THEREOF

(71) Applicant: Integrated Silicon Solution Inc., Milpitas, CA (US)

(72) Inventor: Shuenrun Seara Jian, Milpitas, CA (US)

(73) Assignee: INTEGRATED SILICON SOLUTION INC., Milpitas, CA (US)

( * ) Notice: Subject to any disclaimer, the term of this patent is extended or adjusted under 35 U.S.C. 154(b) by 93 days.

(21) Appl. No.: 17/736,119

(22) Filed: May 4, 2022

(65) Prior Publication Data

US 2023/0176600 A1 Jun. 8, 2023

(30) Foreign Application Priority Data

Dec. 7, 2021 (TW) ..... 110145755

(51) Int. Cl.
*G05F 1/56* (2006.01)
*G05F 1/565* (2006.01)
*G05F 1/46* (2006.01)

(52) U.S. Cl.
CPC ..... *G05F 1/565* (2013.01); *G05F 1/468* (2013.01)

(58) Field of Classification Search
CPC ..... G05F 1/468; G05F 1/565
See application file for complete search history.

(56) References Cited

U.S. PATENT DOCUMENTS 10,199,932 B1 * 2/2019 Hastings ..... H02M 3/07
2016/0026196 A1 * 1/2016 Mnich ..... G05F 1/468 323/281
2022/0140791 A1 * 5/2022 Vangara ..... H03F 1/303 330/90

* cited by examiner

*Primary Examiner* — Jue Zhang
*Assistant Examiner* — Lakaisha Jackson
(74) *Attorney, Agent, or Firm* — McClure, Qualey & Rodack, LLP

(57) ABSTRACT

A controlling circuit for a low-power low dropout regulator includes the low-power low dropout regulator, a current load detector and a bias current circuit. The low-power low dropout regulator has a first transmitting terminal and a second transmitting terminal. The first transmitting terminal is configured to transmit a first voltage, the second transmitting terminal is configured to transmit a second voltage, and the low-power low dropout regulator adjusts a voltage difference between the first voltage and the second voltage. The current load detector detects the first voltage and the second voltage, and compares the reference voltage with the second voltage to generate a detected signal. The bias current circuit generates a bias voltage and a reference current, and the low-power low dropout regulator dynamically adjust a bias current of the low-power low dropout regulator, so that the bias current is positively correlated with the reference current.

20 Claims, 9 Drawing Sheets

CONTROLLING CIRCUIT FOR LOW-POWER LOW DROPOUT REGULATOR AND CONTROLLING METHOD THEREOF

RELATED APPLICATIONS

This application claims priority to Taiwan Application Serial Number 110145755, filed Dec. 7, 2021, which is herein incorporated by reference.

BACKGROUND

Technical Field

The present disclosure relates to a controlling circuit for a regulator and a controlling method thereof. More particularly, the present disclosure relates to a controlling circuit for a low-power low dropout regulator and a controlling method thereof.

Description of Related Art

A general low dropout (LDO) regulator is configured to input a specific voltage (e.g., VDDA) and output another specific voltage (e.g., VCSA), and adjusts the another specific voltage according to a reference voltage. The voltage VCSA is less than the voltage VDD1. In the conventional technology, when the low dropout regulator is in an activation mode, a reaction speed of the low dropout regulator turns slow because of the load. When the low dropout regulator is in a standby mode, the low dropout regulator will still consume a certain amount of power. Accordingly, a controlling circuit for a low-power low dropout regulator and a controlling method thereof having the features of avoiding the slowdown of the reaction speed and saving the power consumption are commercially desirable.

SUMMARY

According to one aspect of the present disclosure, a controlling circuit for a low-power low dropout regulator is configured to control the low-power low dropout regulator according to a reference voltage. The controlling circuit for the low-power low dropout regulator includes the low-power low dropout regulator, a current load detector and a bias current circuit. The low-power low dropout regulator has a first transmitting terminal and a second transmitting terminal. The first transmitting terminal is configured to transmit a first voltage, the second transmitting terminal is configured to transmit a second voltage, and the low-power low dropout regulator adjusts a voltage difference between the first voltage and the second voltage according to the reference voltage. The current load detector is electrically connected to the low-power low dropout regulator. The current load detector detects the first voltage and the second voltage, and compares the reference voltage with the second voltage to generate a detected signal. The bias current circuit is electrically connected to the low-power low dropout regulator and the current load detector. The bias current circuit generates a bias voltage and a reference current according to the detected signal, and the low-power low dropout regulator is controlled by the bias voltage to dynamically adjust a bias current of the low-power low dropout regulator, so that the bias current is positively correlated with the reference current.

According to another aspect of the present disclosure, a controlling circuit for a low-power low dropout regulator is configured to control a first voltage and a second voltage of the low-power low dropout regulator according to a reference voltage. The controlling circuit for the low-power low dropout regulator includes a current load detector and a bias current circuit. The current load detector is electrically connected to the low-power low dropout regulator. The current load detector detects the first voltage and the second voltage, and compares the reference voltage with the second voltage to generate a detected signal. The bias current circuit is electrically connected to the low-power low dropout regulator and the current load detector. The bias current circuit generates a bias voltage and a reference current according to the detected signal, and the low-power low dropout regulator is controlled by the bias voltage to dynamically adjust a bias current of the low-power low dropout regulator, so that the bias current is positively correlated with the reference current. A reaction speed of the current load detector is faster than a reaction speed of the low-power low dropout regulator.

According to further another aspect of the present disclosure, a controlling method for a low-power low dropout regulator is configured to control the low-power low dropout regulator according to a reference voltage. The controlling method for the low-power low dropout regulator includes performing a voltage supplying step, a voltage regulating step, a current load detecting step and a bias current adjusting step. The voltage supplying step includes supplying a first voltage to a low-power low dropout regulator, a current load detector and a bias current circuit. The voltage regulating step includes configuring the low-power low dropout regulator to generate a second voltage according to the first voltage, and adjust a voltage difference between the first voltage of a first transmitting terminal and the second voltage of a second transmitting terminal according to the reference voltage. The current load detecting step includes configuring the current load detector to detect the first voltage and the second voltage and compare the reference voltage with the second voltage to generate a detected signal. The bias current adjusting step includes configuring the bias current circuit to generate a bias voltage and a reference current according to the detected signal and control the low-power low dropout regulator by the bias voltage to dynamically adjust a bias current of the low-power low dropout regulator, so that the bias current is positively correlated with the reference current.

BRIEF DESCRIPTION OF THE DRAWINGS

The present disclosure can be more fully understood by reading the following detailed description of the embodiment, with reference made to the accompanying drawings as follows.

DETAILED DESCRIPTION

The embodiment will be described with the drawings. For clarity, some practical details will be described below. However, it should be noted that the present disclosure should not be limited by the practical details, that is, in some embodiment, the practical details is unnecessary. In addition, for simplifying the drawings, some conventional structures and elements will be simply illustrated, and repeated elements may be represented by the same labels.

It will be understood that when an element (or device) is referred to as be "connected to" another element, it can be directly connected to the other element, or it can be indirectly connected to the other element, that is, intervening elements may be present. In contrast, when an element is referred to as be "directly connected to" another element, there are no intervening elements present. In addition, the terms first, second, third, etc. are used herein to describe various elements or components, these elements or components should not be limited by these terms. Consequently, a first element or component discussed below could be termed a second element or component.

Figure 1:
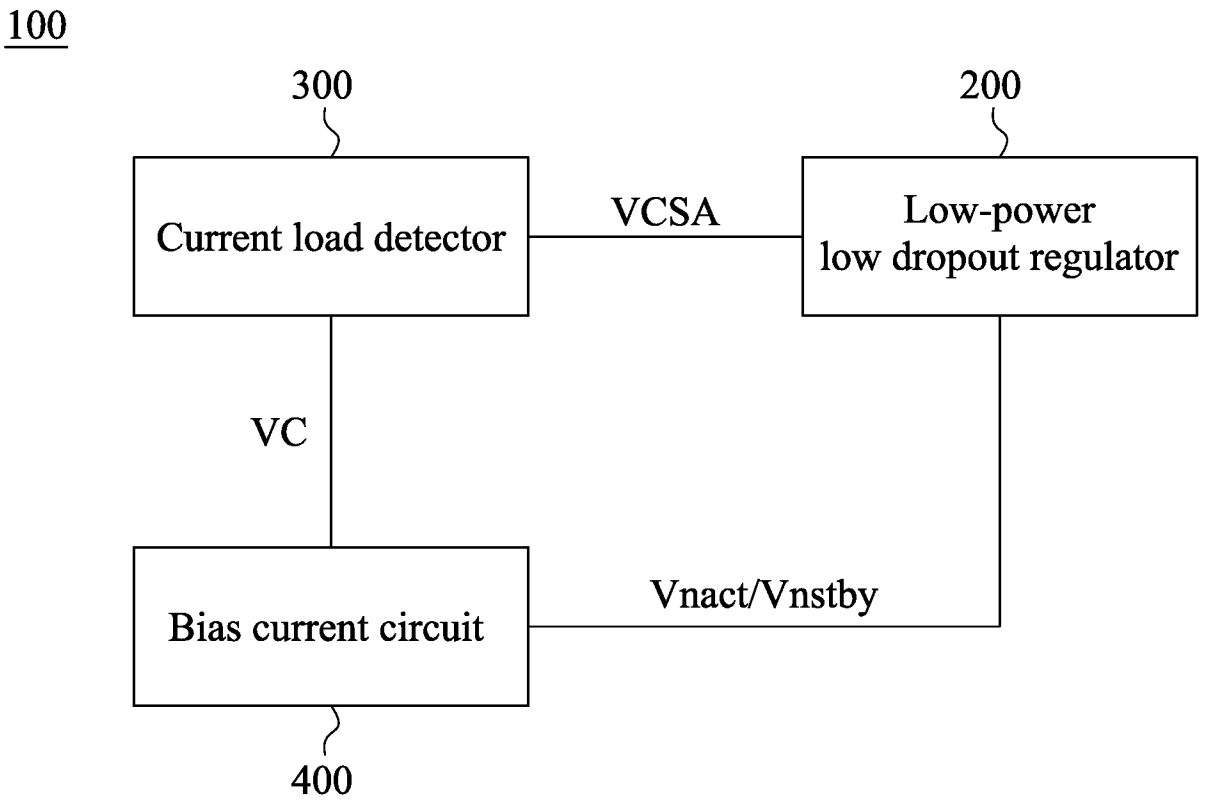
FIG. 1 shows a block diagram of a controlling circuit for a low-power low dropout regulator according to a first embodiment of the present disclosure.

Please refer to FIG. 1. FIG. 1 shows a block diagram of a controlling circuit 100 for a low-power low dropout regulator 200 according to a first embodiment of the present disclosure. The controlling circuit 100 for the low-power low dropout regulator 200 is configured to control the low-power low dropout regulator 200 according to a reference voltage, and includes a low-power low dropout (LDO) regulator 200, a current load detector 300 and a bias current circuit 400. The low-power low dropout regulator 200 has a first transmitting terminal and a second transmitting terminal. The first transmitting terminal is configured to transmit a first voltage VDDA, and the second transmitting terminal is configured to transmit a second voltage VCSA. The low-power low dropout regulator 200 adjusts a voltage difference between the first voltage VDDA and the second voltage VCSA according to the reference voltage. The current load detector 300 is electrically connected to the low-power low dropout regulator 200. The current load detector 300 detects the first voltage VDDA and the second voltage VCSA, and compares the reference voltage with the second voltage VCSA to generate a detected signal VC. The bias current circuit 400 is electrically connected to the low-power low dropout regulator 200 and the current load detector 300. The bias current circuit 400 generates a bias voltage (i.e., one of a bias voltage Vnact and a bias voltage Vnstby, which are represented by "Vnact/Vnstby") and a reference current according to the detected signal VC. The low-power low dropout regulator 200 is controlled by the bias voltage to dynamically adjust a bias current of the low-power low dropout regulator 200, so that the bias current is positively correlated with the reference current. Thus, the controlling circuit 100 for the low-power low dropout regulator 200 of the present disclosure can utilize the current load detector 300, which has a fast reaction speed, to generate the detected signal VC, and dynamically adjust the bias current of the low-power low dropout regulator 200 via the detected signal VC, thereby, maintaining or increasing the reaction speed of the low-power low dropout regulator 200 and saving the power consumption.

Figure 2:
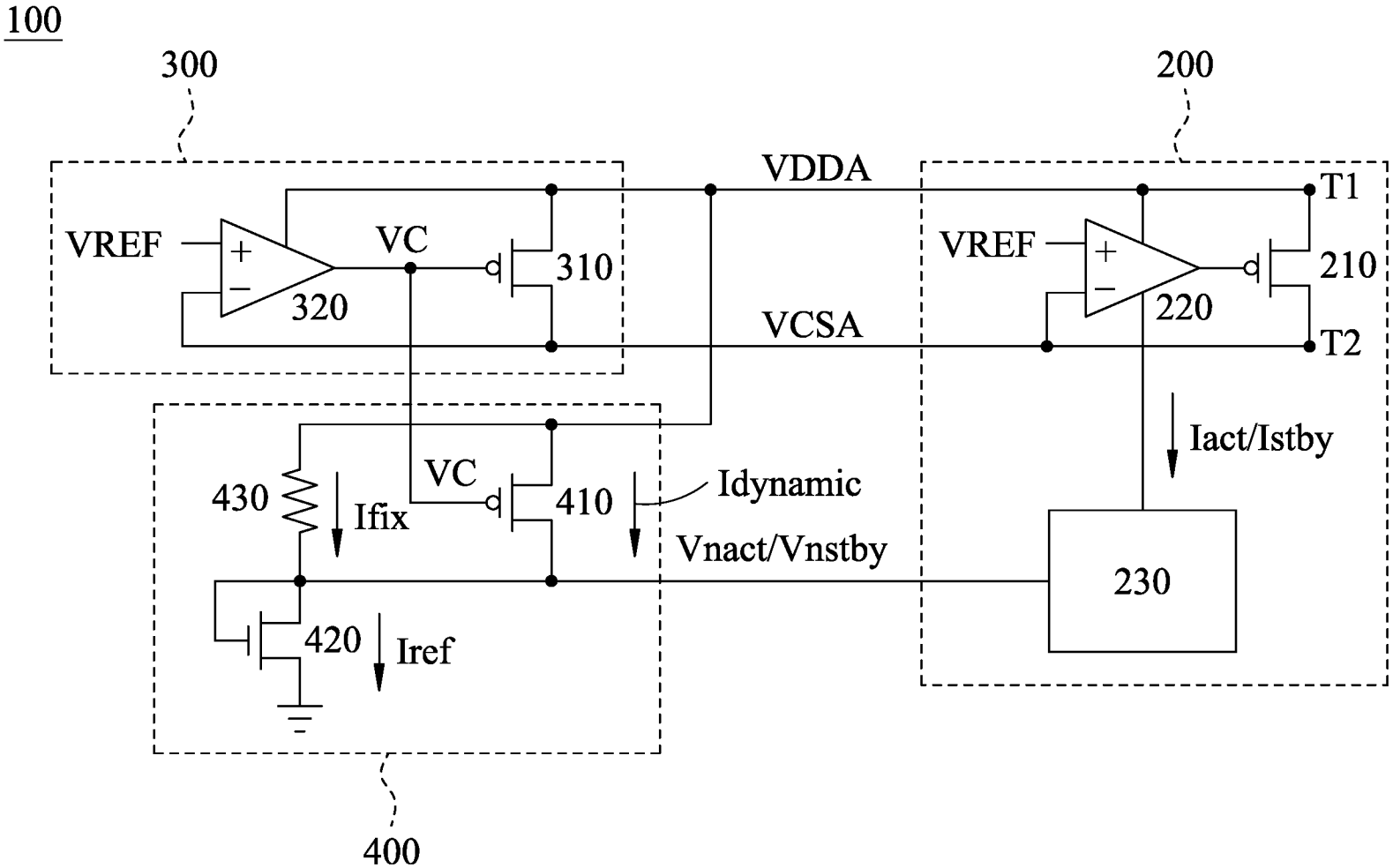
FIG. 2 shows a circuit diagram of a low-power low dropout regulator, a current load detector and a bias current circuit of the controlling circuit for the low-power low dropout regulator of FIG. 1.
Figure 3:
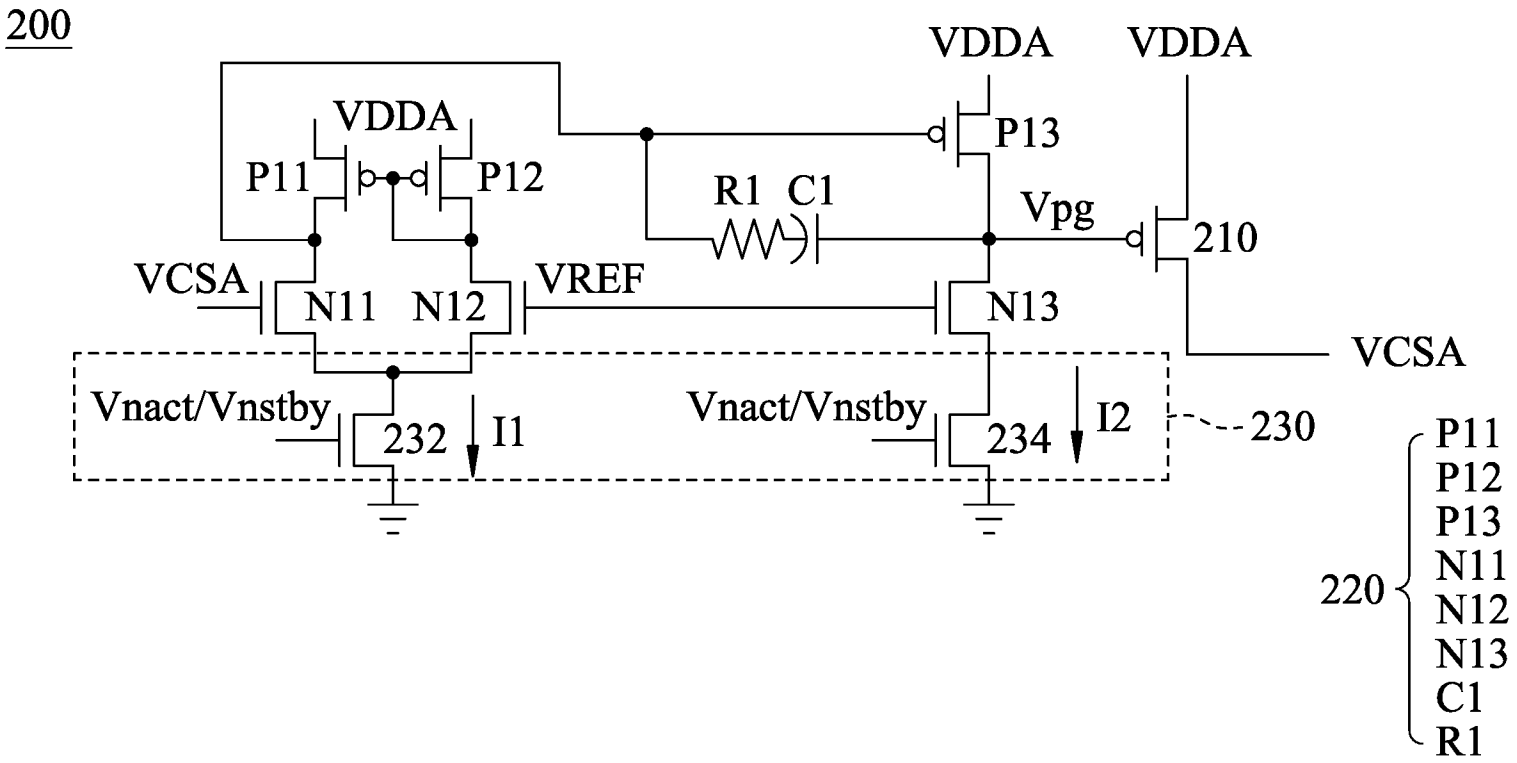
FIG. 3 shows a circuit diagram of the low-power low dropout regulator of FIG. 2.
Figure 4:
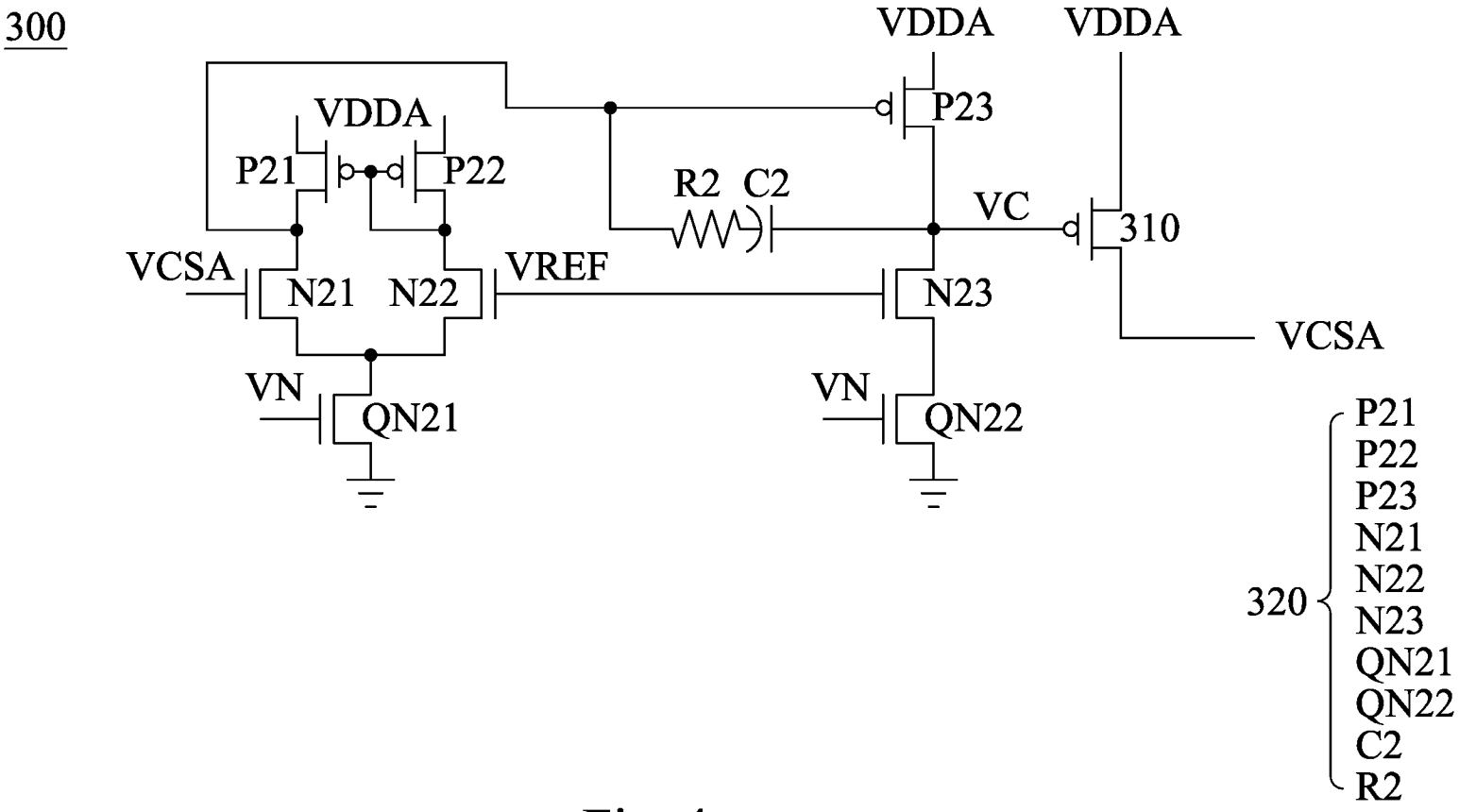
FIG. 4 shows a circuit diagram of the current load detector of FIG. 2.

Please refer to FIG. 1, FIG. 2, FIG. 3 and FIG. 4. FIG. 2 shows a circuit diagram of the low-power low dropout regulator 200, the current load detector 300 and the bias current circuit 400 of the controlling circuit 100 for the low-power low dropout regulator 200 of FIG. 1. FIG. 3 shows a circuit diagram of the low-power low dropout regulator 200 of FIG. 2. FIG. 4 shows a circuit diagram of the current load detector 300 of FIG. 2. As shown in FIG. 1 to FIG. 4, the controlling circuit 100 for the low-power low dropout regulator 200 can be applied to the power management of a memory, but the present disclosure is not limited thereto.

The low-power low dropout regulator 200 has a first transmitting terminal T1 and a second transmitting terminal T2. The first transmitting terminal T1 is configured to transmit a first voltage VDDA. The second transmitting terminal T2 is configured to transmit a second voltage VCSA. The low-power low dropout regulator 200 adjusts a voltage difference between the first voltage VDDA and the second voltage VCSA according to the reference voltage VREF. The first voltage VDDA is greater than the second voltage VCSA. In an embodiment, the first voltage VDDA is an external power and is equal to 1.35 V, and the second voltage VCSA is an internal power and is equal to 0.94 V, but the present disclosure is not limited thereto. The low-power low dropout regulator 200 includes a first transistor 210, a first comparator 220 and a mirrored bias current circuit 230.

The first transistor 210 is electrically connected between the first transmitting terminal T1 and the second transmitting terminal T2. The first transistor 210 has a first source electrode, a first gate electrode and a first drain electrode, and the first source electrode, the first gate electrode and the first drain electrode are electrically connected to the first voltage VDDA, a comparison signal Vpg and the second voltage VCSA, respectively. The first transistor 210 is a PMOS transistor.

The first comparator 220 is electrically connected to the first transmitting terminal T1, the second transmitting terminal T2 and the first transistor 210. The first comparator 220 is configured to compare the reference voltage VREF with the second voltage VCSA to generate the comparison signal Vpg, and the comparison signal Vpg is electrically connected to the first transistor 210 to adjust the voltage difference between the first voltage VDDA and the second voltage VCSA. In detail, the first comparator 220 includes a plurality of transistors P11, P12, P13, N11, N12, N13, a capacitor C1 and a resistor R1. The transistor N11 is electrically connected between the transistor P11 and the mirrored bias current circuit 230. The transistor N12 is electrically connected between the transistor P12 and the mirrored bias current circuit 230. The transistor N13 is electrically connected between the transistor P13 and the mirrored bias current circuit 230. The transistors P11, P12 are connected to each other. The transistor P13 is electrically connected to the transistors P11, N11, N13 and the first transistor 210. The transistor N11 is controlled by the second voltage VCSA. The transistors N12, N13 are controlled by the reference voltage VREF. Any one of the transistors P11, P12, P13 is a PMOS transistor, and any one of the transistors N11, N12, N13 is an NMOS transistor. The capacitor C1 and the resistor R1 are connected to each other in series, and electrically connected between the gate electrode and the drain electrode of the transistor P13 to realize the Miller Compensation.

The mirrored bias current circuit 230 includes a second transistor 232 and a transistor 234. The second transistor 232 and the transistor 234 are both electrically connected to the first comparator 220 and the bias current circuit 400. In detail, the second transistor 232 has a second source electrode, a second gate electrode and a second drain electrode. The second source electrode, the second gate electrode and the second drain electrode are electrically connected to a ground terminal (VSS), the bias current circuit 400 and the first comparator 220, respectively. The second transistor 232 is electrically connected to the transistors N11, N12. The transistor 234 is electrically connected to the transistor N13. The second transistor 232 and the transistor 234 are controlled by the bias voltage (Vnact/Vnstby) to generate a current I1 and a current I2, respectively. The bias current (i.e., one of the bias current Iact and the bias current Istby, which can be represented by "Iact/Istby") is equal to a sum of the current I1 and the current I2. Any of the second transistor 232 and the transistor 234 is an NMOS transistor.

The current load detector 300 includes a third transistor 310 and a second comparator 320. The third transistor 310 is electrically connected between the first transmitting terminal T1 and the second transmitting terminal T2. The third transistor 310 has a third source electrode, a third gate electrode and a third drain electrode. The third source electrode, the third gate electrode and the third drain electrode are electrically connected to the first voltage VDDA, the detected signal VC and the second voltage VCSA, respectively. The third transistor 310 is a PMOS transistor. Moreover, the second comparator 320 is electrically connected to the first transmitting terminal T1, the second transmitting terminal T2 and the third transistor 310. The second comparator 320 is configured to compare the reference voltage VREF with the second voltage VCSA to generate the detected signal VC, and the detected signal VC is electrically connected to the third transistor 310. A circuit structure of the current load detector 300 is the same as a circuit structure of the low-power low dropout regulator 200. An area of the third transistor 310 is less than an area of the first transistor 210. A reaction speed of the current load detector 300 is faster than the reaction speed of the low-power low dropout regulator 200. The reaction speed of the low-power low dropout regulator 200 is proportional to the bias current (Iact/Istby) and inversely proportional to the load. In one embodiment, the reaction speed of the current load detector 300 is 20 times faster than the reaction speed of the low-power low dropout regulator 200, but the present disclosure is not limited thereto.

The second comparator 320 includes a plurality of transistors P21, P22, P23, N21, N22, N23, QN21, QN22, a capacitor C2 and a resistor R2. The transistor N21 is electrically connected between the transistor P21 and the transistor QN21. The transistor N22 is electrically connected between the transistor P22 and the transistor QN21. The transistor N23 is electrically connected between the transistor P23 and the transistor QN22. The transistors P21, P22 are connected to each other. The transistor P23 is electrically connected to the transistors P21, N21, N23 and the third transistor 310. The transistor N21 is controlled by the second voltage VCSA. The transistors N22, N23 are controlled by the reference voltage VREF. The transistors QN21, QN22 are controlled by another bias voltage VN. Any one of the transistors P21, P22, P23 is a PMOS transistor. Any one of the transistors N21, N22, N23, QN21, QN22 is an NMOS transistor. The capacitor C2 and the resistor R2 are connected to each other in series, and electrically connected between the gate electrode and the drain electrode of the transistor P23 to realize the Miller Compensation.

The bias current circuit 400 includes a fourth transistor 410, a fifth transistor 420 and a resistor 430. The fourth transistor 410 is electrically connected between the first transmitting terminal T1 and the second gate electrode of the second transistor 232. The fourth transistor 410 has a fourth source electrode, a fourth gate electrode and a fourth drain electrode. The fourth source electrode, the fourth gate electrode and the fourth drain electrode are electrically connected to the first voltage VDDA, the detected signal VC and the second gate electrode, respectively. The fifth transistor 420 is electrically connected to the fourth transistor 410. The fifth transistor 420 has a fifth source electrode, a fifth gate electrode and a fifth drain electrode. The fifth source electrode, the fifth gate electrode and the fifth drain electrode are electrically connected to the ground terminal, the fifth drain electrode and the fourth drain electrode, respectively. The resistor 430 is electrically connected between the first transmitting terminal T1 and the second gate electrode of the second transistor 232. The fourth transistor 410 is a PMOS transistor, the fifth transistor 420 is an NMOS transistor. A current Ifix and a current Idynamic pass through the resistor 430 and the fourth transistor 410, respectively, and the current Ifix is a constant. A reference current Iref passes through the fifth transistor 420, and the reference current Iref is equal to a sum of the current Ifix and the current Idynamic.

The bias current circuit 400 generates the bias voltage (Vnact/Vnstby) and the reference current Iref according to the detected signal VC. The mirrored bias current circuit 230 of the low-power low dropout regulator 200 is controlled by the bias voltage (Vnact/Vnstby) to dynamically adjust a bias current (Iact/Istby) passed through the mirrored bias current circuit 230, so that the bias current (Iact/Istby) is positively correlated with the reference current Iref. In an embodiment, the bias current (Iact/Istby) of the low-power low dropout regulator 200 is equal to the reference current Iref of the bias current circuit 400, a range of the bias voltage (Vnact/Vnstby) is from a threshold voltage (e.g., 0.2 V) to the first voltage VDDA (e.g., 1.35 V), but the present disclosure is not limited thereto.

Figure 6:
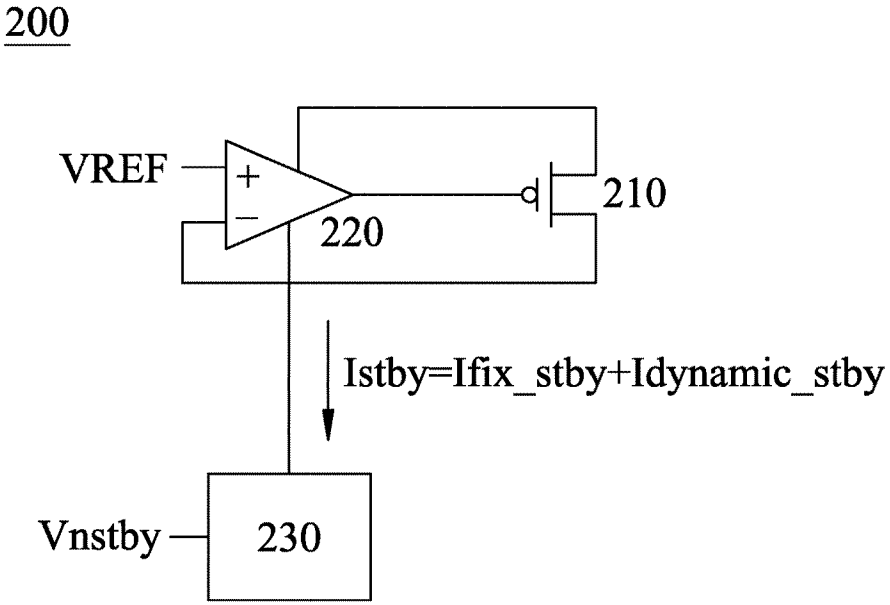
FIG. 6 shows a schematic view of the low-power low dropout regulator of FIG. 2 is in a standby mode.
Figure 5:
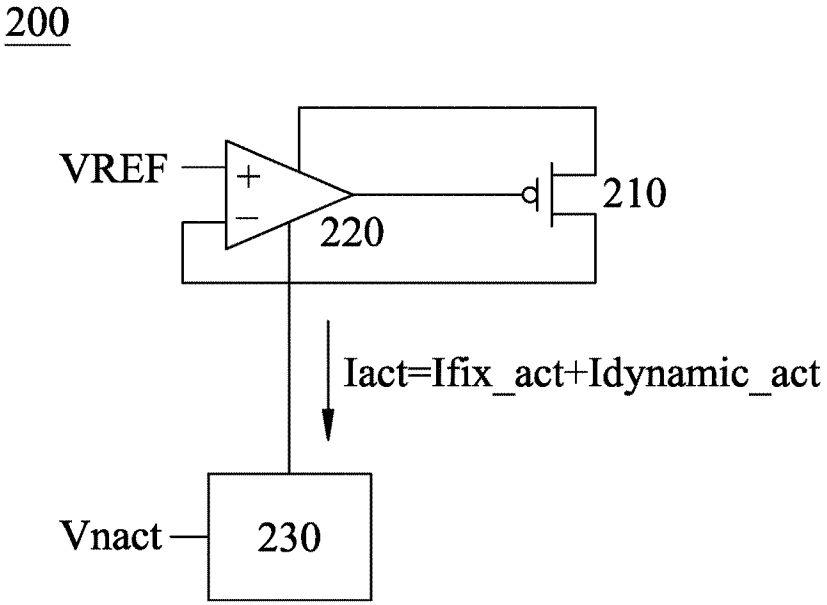
FIG. 5 shows a schematic view of the low-power low dropout regulator of FIG. 2 is in an activation mode.

Please refer to FIG. 2, FIG. 5 and FIG. 6. FIG. 5 shows a schematic view of the low-power low dropout regulator 200 of FIG. 2 is in an activation mode. FIG. 6 shows a schematic view of the low-power low dropout regulator 200 of FIG. 2 is in a standby mode. As shown in FIG. 2, FIG. 5 and FIG. 6, in response to determining that the low-power low dropout regulator 200 is in the activation mode, the detected signal VC generated by the current load detector 300 is at a low voltage level, as the current Idynamic and the reference current Iref increase, the bias current Iact of the low-power low dropout regulator 200 increases, that is, the bias current Iact, the current Idynamic and the reference current Iref are positive correlate. The bias current Iact is equal to the sum of the current Ifix_act and the current Idynamic_act. Otherwise, in response to determining that the low-power low dropout regulator 200 is in the standby mode, the detected signal VC generated by the current load detector 300 is at a high voltage level, as the current Idynamic and the reference current Iref decrease, the bias current Istby of the low-power low dropout regulator 200 decreases, that is, the bias current Istby, the current Idynamic and the reference current Iref are positive correlate. The bias current Istby is equal to the current Ifix_stby and the current Idynamic_stby. Thus, the controlling circuit 100 for the low-power low dropout regulator 200 of the present disclosure can utilize the current load detector 300, which has a fast reaction speed, to generate the detected signal VC, and dynamically adjust the bias current (Iact/Istby) of the low-power low dropout regulator 200 via the detected signal VC and the bias current circuit 400. In response to determining that the low-power low dropout regulator 200 is in the activation mode, the detected signal VC at the low voltage level increases the reference current Iref and the bias current Iact to maintain or increase the reaction speed of the low-power low dropout regulator 200. In response to determining that the low-power low dropout regulator 200 is in the standby mode, the detected signal VC at the high voltage level decreases the reference current Iref and the bias current Istby to save the power consumption substantially (i.e., when the standby mode is IDD3P, the power consumption can be saved by 80%).

Figure 7:
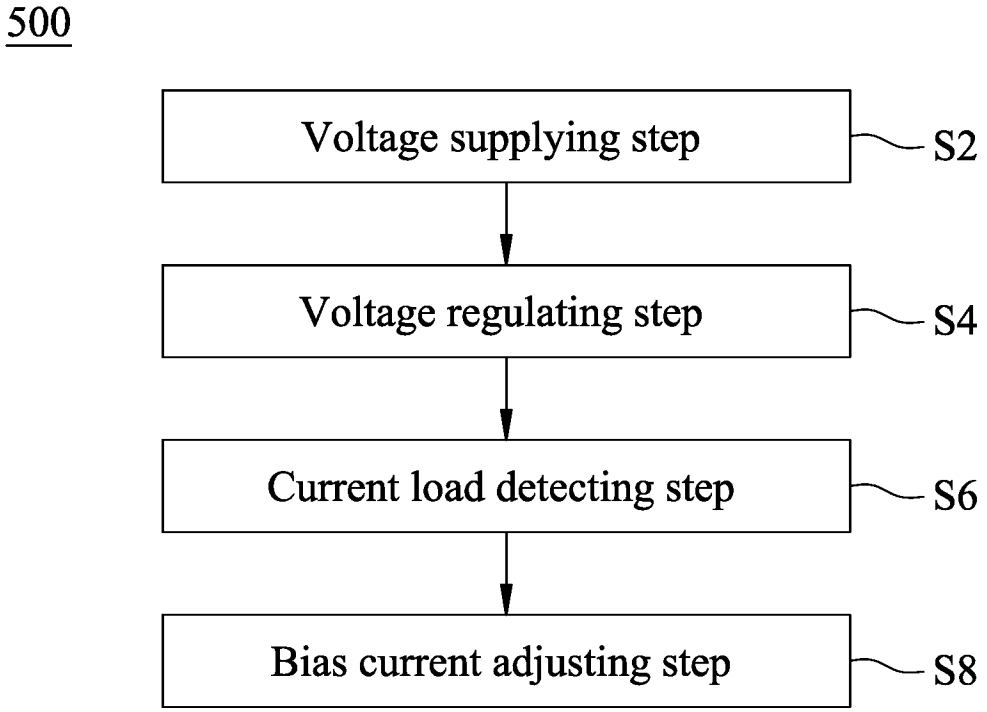
FIG. 7 shows a block diagram of a controlling method for a low-power low dropout regulator according to a second embodiment of the present disclosure.

Please refer to FIG. 1, FIG. 2 and FIG. 7. FIG. 7 shows a block diagram of a controlling method 500 for a low-power low dropout regulator 200 according to a second embodiment of the present disclosure. The controlling method 500 for the low-power low dropout regulator 200 is configured to control the controlling circuit 100 for the low-power low dropout regulator 200 in FIG. 2. The controlling method 500 for the low-power low dropout regulator 200 is configured to control the low-power low dropout regulator 200 according to the reference voltage VREF. The controlling method 500 for the low-power low dropout regulator 200 includes performing a voltage supplying step S2, a voltage regulating step S4, a current load detecting step S6 and a bias current adjusting step S8.

The voltage supplying step S2 includes supplying the first voltage VDDA to the low-power low dropout regulator 200, the current load detector 300 and the bias current circuit 400. The voltage regulating step S4 includes configuring the low-power low dropout regulator 200 to generate the second voltage VCSA according to the first voltage VDDA, and adjust a voltage difference between the first voltage VDDA of the first transmitting terminal T1 and the second voltage VCSA of the second transmitting terminal T2 according to the reference voltage VREF. The current load detecting step S6 includes configuring the current load detector 300 to detect the first voltage VDDA and the second voltage VCSA and compare the reference voltage VREF with the second voltage VCSA to generate the detected signal VC. The bias current adjusting step S8 includes configuring the bias current circuit 400 to generate the bias voltage (Vnact/Vnstby) and the reference current Iref according to the detected signal VC and control the low-power low dropout regulator 200 by the bias voltage (Vnact/Vnstby) to dynamically adjust the bias current (Iact/Istby) of the low-power low dropout regulator 200, so that the bias current (Iact/Istby) is positively correlated with the reference current Iref. Thus, the controlling method 500 for the low-power low dropout regulator 200 of the present disclosure can utilize the current load detector 300, which has a fast reaction speed, to generate the detected signal VC, and dynamically adjust the bias current (Iact/Istby) of the low-power low dropout regulator 200 via the detected signal VC and the bias current circuit 400, thereby, maintaining or increasing the reaction speed of the low-power low dropout regulator 200 and saving the power consumption.

Figure 8:
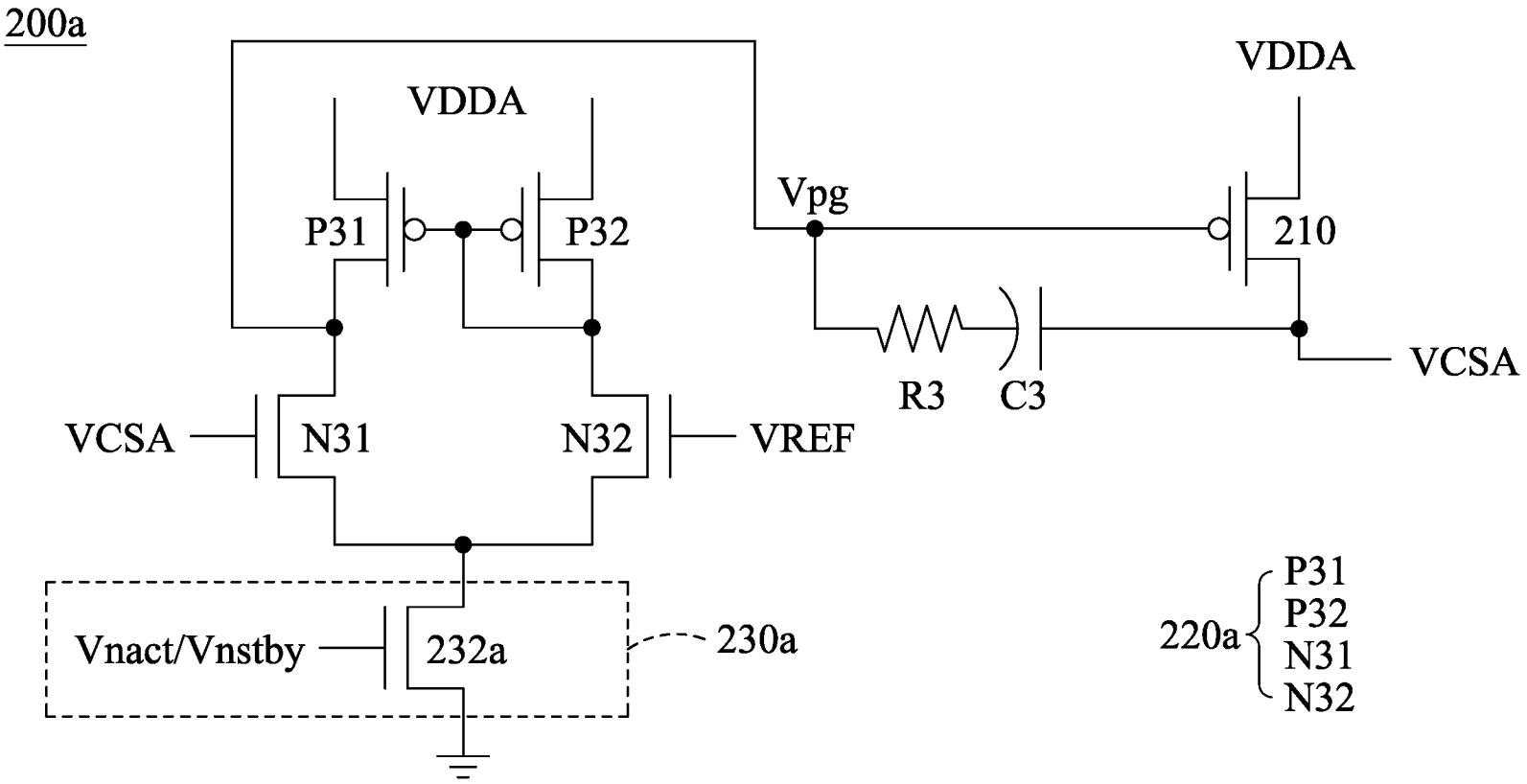
FIG. 8 shows a circuit diagram of a controlling circuit for a low-power low dropout regulator according to a third embodiment of the present disclosure.

Please refer to FIG. 2, FIG. 3 and FIG. 8. FIG. 8 shows a circuit diagram of a controlling circuit for a low-power low dropout regulator 200*a* according to a third embodiment of the present disclosure. The low-power low dropout regulator 200*a* includes a first transistor 210, a comparator 220*a* and a mirrored bias current circuit 230*a*. The first transistor 210 is electrically connected between the first voltage VDDA and the second voltage VCSA. The first transistor 210 is a PMOS transistor and includes a source electrode, a gate electrode and a drain electrode. The source electrode, the gate electrode and the drain electrode are electrically connected to the first voltage VDDA, the comparison signal Vpg and the second voltage VCSA, respectively. The comparator 220*a* is electrically connected to the first voltage VDDA, the second voltage VCSA, the first transistor 210 and the mirrored bias current circuit 230*a*, and the comparator 220*a* is configured to compare the reference voltage VREF with the second voltage VCSA to generate the comparison signal Vpg. The comparison signal Vpg is electrically connected to the first transistor 210 to adjust the voltage difference between the first voltage VDDA and the second voltage VCSA. The comparator 220*a* includes a plurality of transistors P31, P32, N31, N32. The transistor N31 is electrically connected between the transistor P31 and the mirrored bias current circuit 230*a*. The transistor N32 is electrically connected between the transistor P32 and the mirrored bias current circuit 230*a*, and the transistors P31, P32 are connected to each other. The mirrored bias current circuit 230*a* is consisted of the second transistor 232*a*. The transistors N31, N32 and the second transistor 232*a* are controlled by the second voltage VCSA, the reference voltage VREF and the bias voltage (Vnact/Vnstby). Any one of the transistors P31, P32 is a PMOS transistor, and any one of the transistors N31, N32 and the second transistor 232*a* is an NMOS transistor. Moreover, the low-power low dropout regulator 200*a* further includes a resistor R3 and a capacitor C3. The resistor R3 and the capacitor C3 are electrically connected between the gate electrode and the drain electrode of the first transistor 210.

Figure 9:
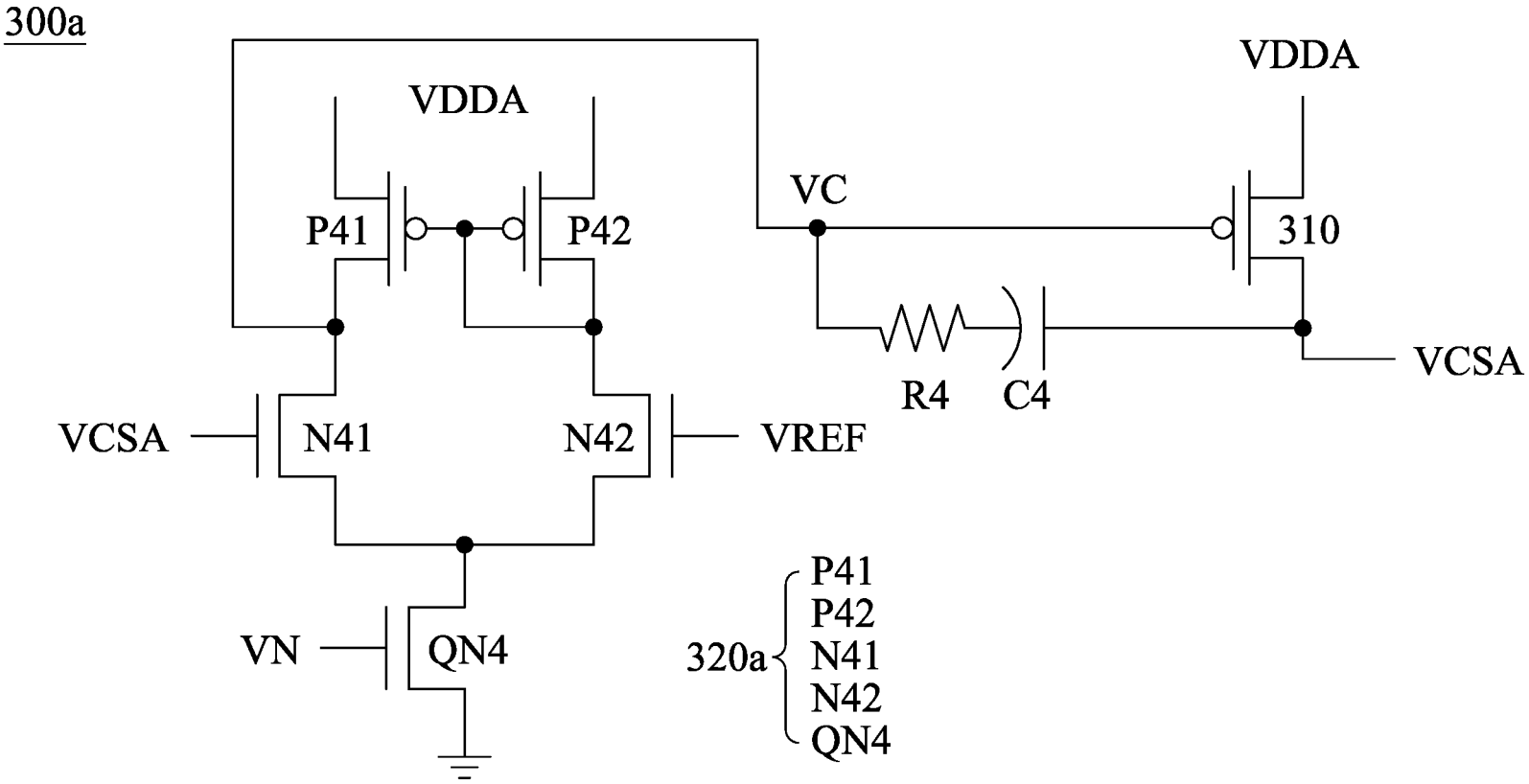
FIG. 9 shows a circuit diagram of a current load detector of a controlling circuit for a low-power low dropout regulator according to a fourth embodiment of the present disclosure.

Please refer to FIG. 2, FIG. 4 and FIG. 9. FIG. 9 shows a circuit diagram of a current load detector 300*a* of a controlling circuit for a low-power low dropout regulator according to a fourth embodiment of the present disclosure. The current load detector 300*a* includes a third transistor 310 and a second comparator 320*a*. The third transistor 310 is electrically connected between the first voltage VDDA and the second voltage VCSA. The third transistor 310 is a PMOS transistor and has a third source electrode, a third gate electrode and a third drain electrode. The third source electrode, the third gate electrode and the third drain electrode are electrically connected to the first voltage VDDA, the detected signal VC and the second voltage VCSA, respectively. The second comparator 320*a* is electrically connected to the first voltage VDDA, the second voltage VCSA and the third transistor 310. The second comparator 320*a* is configured to compare the reference voltage VREF with the second voltage VCSA to generate the detected signal VC. The detected signal VC is electrically connected to the third transistor 310. The second comparator 320*a* includes a plurality of transistors P41, P42, N41, N42, QN4. The transistor N41 is electrically connected between the transistors P41, QN4. The transistor N42 is electrically connected between the transistors P42, QN4. The transistors P41, P42 are connected to each other. The transistors N41, N42, QN4 are controlled by the second voltage VCSA, the reference voltage VREF and another bias voltage VN. Any one of the transistors P41, P42 is a PMOS transistor, any one of the transistors N41, N42, QN4 is an NMOS transistor. Moreover, the current load detector 300*a* further includes a capacitor C4 and a resistor R4. The capacitor C4 and the resistor R4 are connected to each other in series, and electrically connected between the gate electrode and the drain electrode of the third transistor 310.

Figure 10:
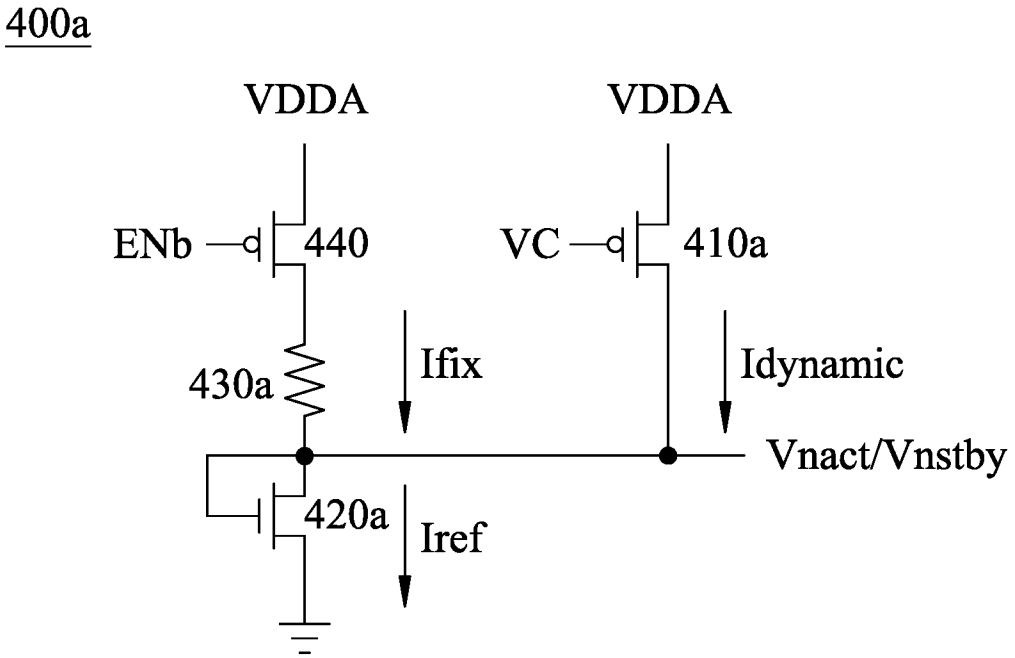
FIG. 10 shows a circuit diagram of a bias current circuit of a controlling circuit for a low-power low dropout regulator according to a fifth embodiment of the present disclosure.

Please refer to FIG. 2 and FIG. 10. FIG. 10 shows a circuit diagram of a bias current circuit 400*a* of a controlling circuit for a low-power low dropout regulator according to a fifth embodiment of the present disclosure. The bias current circuit 400*a* includes a fourth transistor 410*a*, a fifth transistor 420*a*, a resistor 430*a* and a transistor 440. The structure of the fourth transistor 410*a*, the fifth transistor 420*a* and the resistor 430*a* are the same as the fourth transistor 410, the fifth transistor 420 and the resistor 430 in FIG. 2, respectively, and will not be described again. The transistor 440 in FIG. 10 is electrically connected between the first voltage VDDA and the resistor 430*a*. The transistor 440 is controlled by a start-up signal ENb. The transistor 440 is a PMOS transistor, and is configured to control the current Ifix.

In other embodiments, the low-power low dropout regulator and the current load detector can be circuits of variety of LDO structure, but the present disclosure is not limited thereto.

According to the aforementioned embodiments and examples, the advantages of the present disclosure are described as follows.

1. The controlling circuit for the low-power low dropout regulator 200 of the present disclosure can utilize the current load detector, which has a fast reaction speed, to generate the detected signal, and dynamically adjust the bias current of the low-power low dropout regulator via the detected signal, thereby, maintaining or increasing the reaction speed of the low-power low dropout regulator to has a high voltage stability and saving the power consumption. Therefore, the controlling circuit for the low-power low dropout regulator 200 of the present disclosure can solve the problem of the conventional low dropout regulator that the reaction speed of the low-power low dropout regulator turn slow in the activation mode, and the power consumption in the standby mode is too much.

2. In response to determining that the low-power low dropout regulator is in the activation mode, the detected signal at the low voltage level increases the reference current and the bias current to maintain or increase the reaction speed of the low-power low dropout regulator.

3. In response to determining that the low-power low dropout regulator is in the standby mode, the detected signal at the high voltage level decreases the reference current and the bias current to save the power consumption substantially (i.e., when the standby mode is IDD3P, the power consumption can be saved by 80%).

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A controlling circuit for a low-power low dropout regulator, which is configured to control the low-power low dropout regulator according to a reference voltage, and the controlling circuit for the low-power low dropout regulator comprising:

the low-power low dropout regulator having a first transmitting terminal and a second transmitting terminal, wherein the first transmitting terminal is configured to transmit a first voltage, the second transmitting terminal is configured to transmit a second voltage, and the low-power low dropout regulator adjusts a voltage difference between the first voltage and the second voltage according to the reference voltage;

a current load detector electrically connected to the low-power low dropout regulator, wherein the current load detector detects the first voltage and the second voltage, and compares the reference voltage with the second voltage to generate a detected signal; and a bias current circuit electrically connected to the low-power low dropout regulator and the current load detector, wherein the bias current circuit generates a bias voltage and a reference current according to the detected signal, and the low-power low dropout regulator is controlled by the bias voltage to dynamically adjust a bias current of the low-power low dropout regulator, so that the bias current is positively correlated with the reference current.

2. The controlling circuit for the low-power low dropout regulator of claim 1, wherein the first voltage is greater than the second voltage, and the bias current of the low-power low dropout regulator is equal to the reference current of the bias current circuit.

3. The controlling circuit for the low-power low dropout regulator of claim 1, wherein the low-power low dropout regulator comprises:

a first transistor electrically connected between the first transmitting terminal and the second transmitting terminal;

a first comparator electrically connected to the first transmitting terminal, the second transmitting terminal and the first transistor, wherein the first comparator is configured to compare the reference voltage with the second voltage to generate a comparison signal, and the comparison signal is electrically connected to the first transistor to adjust the voltage difference between the first voltage and the second voltage; and a second transistor electrically connected to the first comparator and the bias current circuit;

wherein the first transistor has a first source electrode, a first gate electrode and a first drain electrode, and the first source electrode, the first gate electrode and the first drain electrode are electrically connected to the first voltage, the comparison signal and the second voltage, respectively;

wherein the second transistor has a second source electrode, a second gate electrode and a second drain electrode, and the second source electrode, the second gate electrode and the second drain electrode are electrically connected to a ground terminal, the bias current circuit and the first comparator, respectively.

4. The controlling circuit for the low-power low dropout regulator of claim 3, wherein the current load detector comprises:

a third transistor electrically connected between the first transmitting terminal and the second transmitting terminal; and a second comparator electrically connected to the first transmitting terminal, the second transmitting terminal and the third transistor, wherein the second comparator is configured to compare the reference voltage with the second voltage to generate the detected signal, and the detected signal is electrically connected to the third transistor;

wherein the third transistor has a third source electrode, a third gate electrode and a third drain electrode, and the third source electrode, the third gate electrode and the third drain electrode are electrically connected to the first voltage, the detected signal and the second voltage, respectively.

5. The controlling circuit for the low-power low dropout regulator of claim 4, wherein the bias current circuit comprises:

a fourth transistor electrically connected between the first transmitting terminal and the second gate electrode of the second transistor, wherein the fourth transistor has a fourth source electrode, a fourth gate electrode and a fourth drain electrode, and the fourth source electrode, the fourth gate electrode and the fourth drain electrode are electrically connected to the first voltage, the detected signal and the second gate electrode, respectively;

a fifth transistor electrically connected to the fourth transistor, wherein the fifth transistor has a fifth source electrode, a fifth gate electrode and a fifth drain electrode, and the fifth source electrode, the fifth gate electrode and the fifth drain electrode are electrically connected to the ground terminal, the fifth drain electrode and the fourth drain electrode, respectively; and a resistor electrically connected between the first transmitting terminal and the second gate electrode of the second transistor;

wherein each of the first transistor, the third transistor and the fourth transistor is a PMOS transistor, and each of the second transistor and the fifth transistor is NMOS transistor.

6. The controlling circuit for the low-power low dropout regulator of claim 4, wherein an area of the third transistor is less than an area of the first transistor.

7. The controlling circuit for the low-power low dropout regulator of claim 1, wherein, in response to determining that the low-power low dropout regulator is in an activation mode, the detected signal generated by the current load detector is at a low voltage level, as the reference current increases, the bias current of the low-power low dropout regulator increases; and in response to determining that the low-power low dropout regulator is in a standby mode, the detected signal generated by the current load detector is at a high voltage level, as the reference current decreases, the bias current of the low-power low dropout regulator decreases.

8. A controlling circuit for a low-power low dropout regulator, which is configured to control a first voltage and a second voltage of the low-power low dropout regulator according to a reference voltage, and the controlling circuit for the low-power low dropout regulator comprising:

a current load detector electrically connected to the low-power low dropout regulator, wherein the current load detector detects the first voltage and the second voltage, and compares the reference voltage with the second voltage to generate a detected signal; and a bias current circuit electrically connected to the low-power low dropout regulator and the current load detector, wherein the bias current circuit generates a bias voltage and a reference current according to the detected signal, and the low-power low dropout regulator is controlled by the bias voltage to dynamically adjust a bias current of the low-power low dropout regulator, so that the bias current is positively correlated with the reference current;

wherein a reaction speed of the current load detector is faster than a reaction speed of the low-power low dropout regulator.

9. The controlling circuit for the low-power low dropout regulator of claim 8, wherein the first voltage is greater than the second voltage, and the bias current of the low-power low dropout regulator is equal to the reference current of the bias current circuit.

10. The controlling circuit for the low-power low dropout regulator of claim 8, wherein the low-power low dropout regulator comprises:

a first transistor electrically connected between a first transmitting terminal and a second transmitting terminal;

a first comparator electrically connected to the first transmitting terminal, the second transmitting terminal and the first transistor, wherein the first comparator is configured to compare the reference voltage with the second voltage to generate a comparison signal, and the comparison signal is electrically connected to the first transistor to adjust a voltage difference between the first voltage and the second voltage; and a second transistor electrically connected to the first comparator and the bias current circuit;

wherein the first transistor has a first source electrode, a first gate electrode and a first drain electrode, and the first source electrode, the first gate electrode and the first drain electrode are electrically connected to the first voltage, the comparison signal and the second voltage, respectively;

wherein the second transistor has a second source electrode, a second gate electrode and a second drain electrode, and the second source electrode, the second gate electrode and the second drain electrode are electrically connected to a ground terminal, the bias current circuit and the first comparator, respectively.

11. The controlling circuit for the low-power low dropout regulator of claim 10, wherein the current load detector comprises:

a third transistor electrically connected between the first transmitting terminal and the second transmitting terminal; and a second comparator electrically connected to the first transmitting terminal, the second transmitting terminal and the third transistor, wherein the second comparator is configured to compare the reference voltage with the second voltage to generate the detected signal, and the detected signal is electrically connected to the third transistor;

wherein the third transistor has a third source electrode, a third gate electrode and a third drain electrode, and the third source electrode, the third gate electrode and the third drain electrode are electrically connected to the first voltage, the detected signal and the second voltage, respectively.

12. The controlling circuit for the low-power low dropout regulator of claim 11, wherein the bias current circuit comprises:

a fourth transistor electrically connected between the first transmitting terminal and the second gate electrode of the second transistor, wherein the fourth transistor has a fourth source electrode, a fourth gate electrode and a fourth drain electrode, and the fourth source electrode, the fourth gate electrode and the fourth drain electrode are electrically connected to the first voltage, the detected signal and the second gate electrode, respectively;

a fifth transistor electrically connected to the fourth transistor, wherein the fifth transistor has a fifth source electrode, a fifth gate electrode and a fifth drain electrode, and the fifth source electrode, the fifth gate electrode and the fifth drain electrode are electrically connected to the ground terminal, the fifth drain electrode and the fourth drain electrode, respectively; and a resistor electrically connected between the first transmitting terminal and the second gate electrode of the second transistor;

wherein each of the first transistor, the third transistor and the fourth transistor is a PMOS transistor, and each of the second transistor and the fifth transistor is NMOS transistor.

13. The controlling circuit for the low-power low dropout regulator of claim 11, wherein an area of the third transistor is less than an area of the first transistor.

14. The controlling circuit for the low-power low dropout regulator of claim 8, wherein, in response to determining that the low-power low dropout regulator is in an activation mode, the detected signal generated by the current load detector is at a low voltage level, as the reference current increases, the bias current of the low-power low dropout regulator increases; and in response to determining that the low-power low dropout regulator is in a standby mode, the detected signal generated by the current load detector is at a high voltage level, as the reference current decreases, the bias current of the low-power low dropout regulator decreases.

15. A controlling method for a low-power low dropout regulator, which is configured to control the low-power low dropout regulator according to a reference voltage, and the controlling method for the low-power low dropout regulator comprising:

performing a voltage supplying step, wherein the voltage supplying step comprises supplying a first voltage to a low-power low dropout regulator, a current load detector and a bias current circuit;

performing a voltage regulating step, wherein the voltage regulating step comprises configuring the low-power low dropout regulator to generate a second voltage according to the first voltage, and adjust a voltage difference between the first voltage of a first transmitting terminal and the second voltage of a second transmitting terminal according to the reference voltage;

performing a current load detecting step, wherein the current load detecting step comprises configuring the current load detector to detect the first voltage and the second voltage and compare the reference voltage with the second voltage to generate a detected signal; and performing a bias current adjusting step, wherein the bias current adjusting step comprises configuring the bias current circuit to generate a bias voltage and a reference current according to the detected signal and control the low-power low dropout regulator by the bias voltage to dynamically adjust a bias current of the low-power low dropout regulator, so that the bias current is positively correlated with the reference current.

16. The controlling method for the low-power low dropout regulator of claim 15, wherein a reaction speed of the current load detector is faster than a reaction speed of the low-power low dropout regulator.

17. The controlling method for the low-power low dropout regulator of claim 15, wherein the first voltage is greater than the second voltage, and the bias current of the low-power low dropout regulator is equal to the reference current of the bias current circuit.

18. The controlling method for the low-power low dropout regulator of claim 15, wherein, the low-power low dropout regulator comprises:

a first transistor electrically connected between the first transmitting terminal and the second transmitting terminal;

a first comparator electrically connected to the first transmitting terminal, the second transmitting terminal and the first transistor; and a second transistor electrically connected to the first comparator and the bias current circuit; and the current load detector comprises:

a third transistor electrically connected between the first transmitting terminal and the second transmitting terminal; and a second comparator electrically connected to the first transmitting terminal, the second transmitting terminal and the third transistor;

wherein an area of the third transistor is less than an area of the first transistor.

19. The controlling method for the low-power low dropout regulator of claim 15, wherein in response to determining that the low-power low dropout regulator is in an activation mode, the detected signal generated by the current load detector is at a low voltage level, as the reference current increases, the bias current of the low-power low dropout regulator increases.

20. The controlling method for the low-power low dropout regulator of claim 15, wherein in response to determining that the low-power low dropout regulator is in a standby mode, the detected signal generated by the current load detector is at a high voltage level, as the reference current decreases, the bias current of the low-power low dropout regulator decreases.

* * * * *